US008608343B2

(12) United States Patent
Filtz

(10) Patent No.: US 8,608,343 B2
(45) Date of Patent: Dec. 17, 2013

(54) LIGHTING SYSTEMS AND METHODS FOR INSTALLING SAME

(76) Inventor: Timothy J. Filtz, Hopatcong, NJ (US)

( * ) Notice: Subject to any disclaimer, the term of this patent is extended or adjusted under 35 U.S.C. 154(b) by 66 days.

(21) Appl. No.: 13/250,555

(22) Filed: Sep. 30, 2011

(65) Prior Publication Data

US 2012/0170273 A1 Jul. 5, 2012

Related U.S. Application Data

(60) Provisional application No. 61/388,474, filed on Sep. 30, 2010.

(51) Int. Cl.
*F21V 21/00* (2006.01)

(52) U.S. Cl.
USPC ..... 362/249.14; 362/227; 362/249.01; 362/249.07; 362/249.16; 362/806

(58) Field of Classification Search
USPC ..... 362/217.01, 217.1, 217.11, 217.12, 362/217.14, 227, 234, 249.01, 249.07, 362/249.14, 249.16, 253, 382, 404, 806
See application file for complete search history.

(56) References Cited

U.S. PATENT DOCUMENTS 6,132,063 A * 10/2000 Byers ..... 362/249.11
7,114,205 B2 * 10/2006 Choi ..... 5/114

* cited by examiner

*Primary Examiner* — Jason Moon Han
*Assistant Examiner* — Meghan Dunwiddie
(74) *Attorney, Agent, or Firm* — Dale J. Ream

(57) ABSTRACT

Embodiments of collapsible and adjustable support frames hold sockets of light strings at an equal distance and orientation to each other. Each frame can include, for example, a scissor frame with a locking slide arm on both ends to facilitate connection of the scissor frame of other scissor frames. Removable hooks that can be used from a vertical to a horizontal orientation from a gutter or any means that supports said hooks and adjustable light socket clips that can be rotated so as to be used in any orientation. This device can be adjusted and equipped with lights on the ground, thereby facilitating a reduction in the time need to install the light string. After use, the frames can be collapsed with the light string installed thereon to facilitate storage.

15 Claims, 14 Drawing Sheets

LIGHTING SYSTEMS AND METHODS FOR INSTALLING SAME

CROSS-REFERENCE TO RELATED APPLICATIONS

This application claims the benefit under 35 U.S.C. §119 (e) of U.S. Provisional Application No. 61/388,474, filed Oct. 30, 2010, the contents of which is incorporated by reference herein in its entirety.

TECHNICAL FIELD

The embodiments and methods disclosed herein relate to electric lighting such as but not limited to strings of decorative electric lights.

BACKGROUND

Electric lights can be arranged in strings containing multiple lights. For example, many homeowners install strings of decorative electric lights on exterior of their homes during the holiday season. A typical string of decorative lights typically can include a plurality of light sockets connected by wiring, and plurality of lights each mounted in a respective socket. Each socket can include a clip that facilitates mounting of the string. The clips typically need to be installed on a mounting surface, such as the eve of a roof, on a manual basis. Mounting the clips, therefore, can be a time-consuming task. In applications where the mounting location is high off the ground, mounting each clip individually can present a substantial hazard to the installer. Moreover, it can be difficult to space the light clips evenly to achieve a uniform appearance along the light string. Also, the wiring of the string of decorative lights can easily become tangled during storage, further adding to the time and effort needed to install the string during its next use.

SUMMARY

Embodiments of support frames for light strings can hold mounting clips for light sockets of the light string at a substantially uniform spacing from adjacent clips. A light string can be mounted on the support frame at a relatively safe location, such as on the ground, and the frame and string can then be hung with a minimum of time and effort. For example, in some embodiments, the frame can be suspended from only two mounting points. Minimizing installation time can help to reduce the hazard to which the installer is exposed, especially where the mounting surface is located high off the ground. Moreover, relatively uniform spacing between adjacent lights can be achieved with relative ease.

In one possible embodiment, a collapsible and adjustable light support system comprises one or more scissor frames, with the overall number of frames being determined by the number of light sockets to be supported. The frames include rotating light socket clips that can be attached at the center pivots of the frame arms. The clips are sized for the particular light sockets to be supported on the frames. The scissor frames can include locking slide arms at both ends to facilitate adjustment of overall length of the system.

In accordance with one aspect of the inventive concepts disclosed herein, a lighting system includes a collapsible frame movable between an open position at which the frame has a first length, and a second position at which the frame has a second length that is less than the first length. The lighting system also includes a light string mounted on the frame.

In accordance with another aspect of the inventive concepts disclosed herein, a method for mounting a light string can include providing a collapsible frame movable between an open position at which the frame has a first length, and a second position at which the frame has a second length that is less than the first length. The method can also include mounting the light string on the frame while the frame is in the open position, subsequently moving the frame and the light string to a mounting location, and suspending the frame and the light string from a mounting provision at the mounting location.

In accordance with a further aspect of the inventive concepts disclosed herein, a method for mounting a light string includes moving a collapsible frame having the light string mounted thereon to a mounting area, and suspending the frame and the light string from a mounting provision at the mounting area while the frame is in an extended position.

DRAWING DESCRIPTIONS

The foregoing summary, as well as the following detailed description of preferred embodiments, are better understood when read in conjunction with the appended diagrammatic drawings. The drawings are presented for illustrative purposes only, and the scope of the appended claims is not limited to the specific embodiments shown in the drawings. In the drawings:

DETAILED DESCRIPTION

An embodiment of a lighting system is depicted in FIGS. 1-10. The system comprises a hanger or frame 1, and a light string 12 that can be mounted on the frame 1. The frame 1 is movable between an open and locked position depicted in FIG. 1, and a closed or collapsed condition depicted in FIG. 2. The light string 12 can be, for example, a string of decorative outdoor lights typically installed on the exterior of home during the holiday season.

Figure 7:
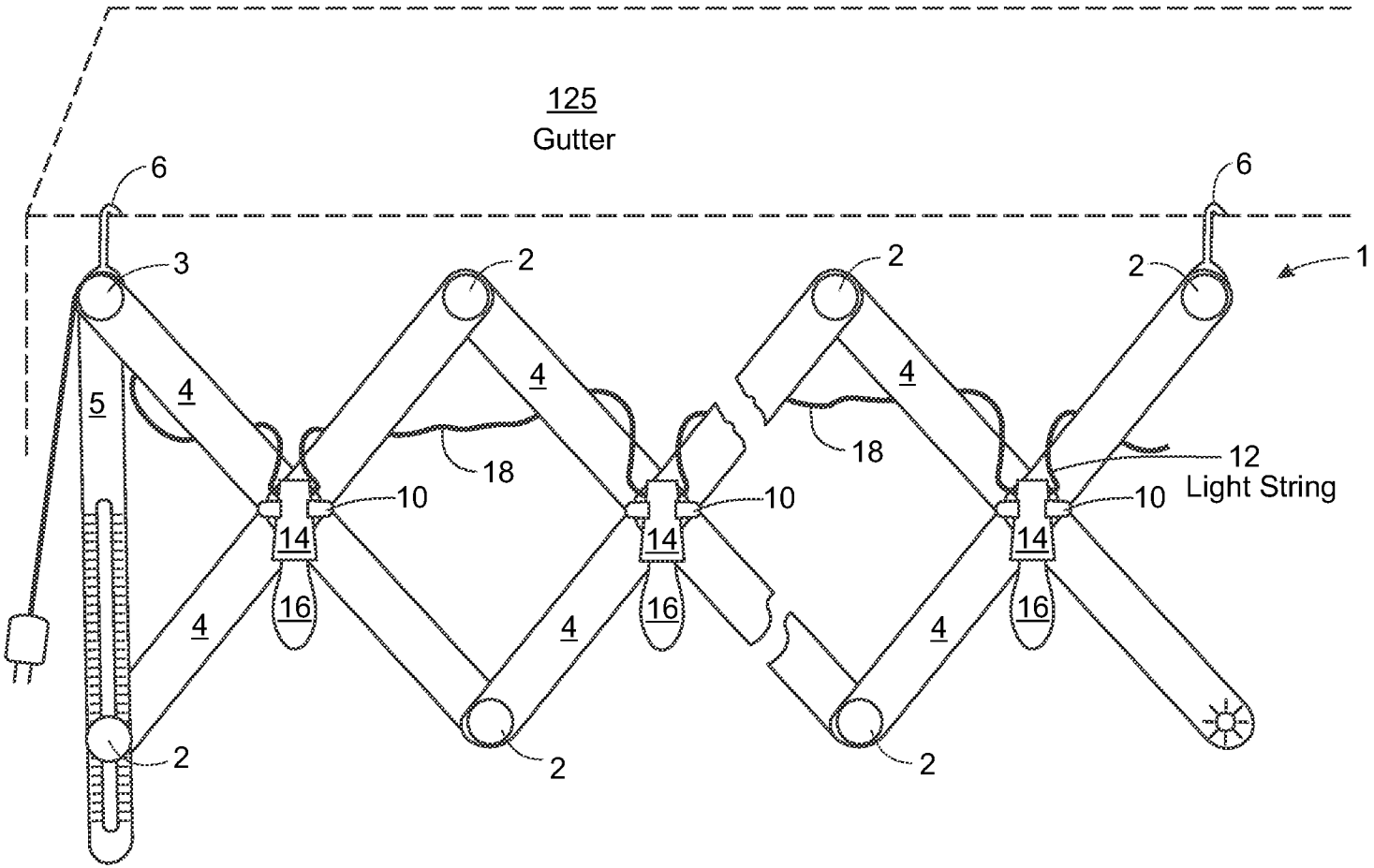
Figure 8:
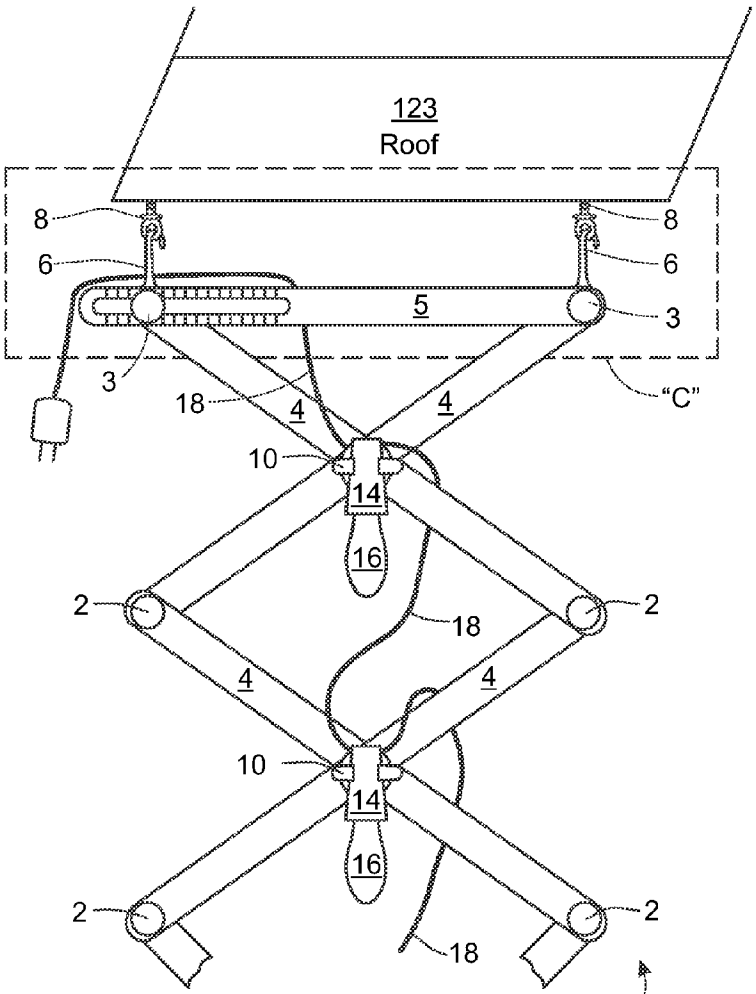
FIG. 8 is a front view of the frame shown in FIGS. 1-7, suspended in a substantially horizontal orientation from a roof eave, with light string installed on the frame.

The light string 12 can include a plurality of light sockets 14 that each accommodates a light bulb 16, and wiring 18 that electrically connects, and conducts electrical power to the light sockets 14, as shown in FIGS. 7 and 8.

Figure 1:
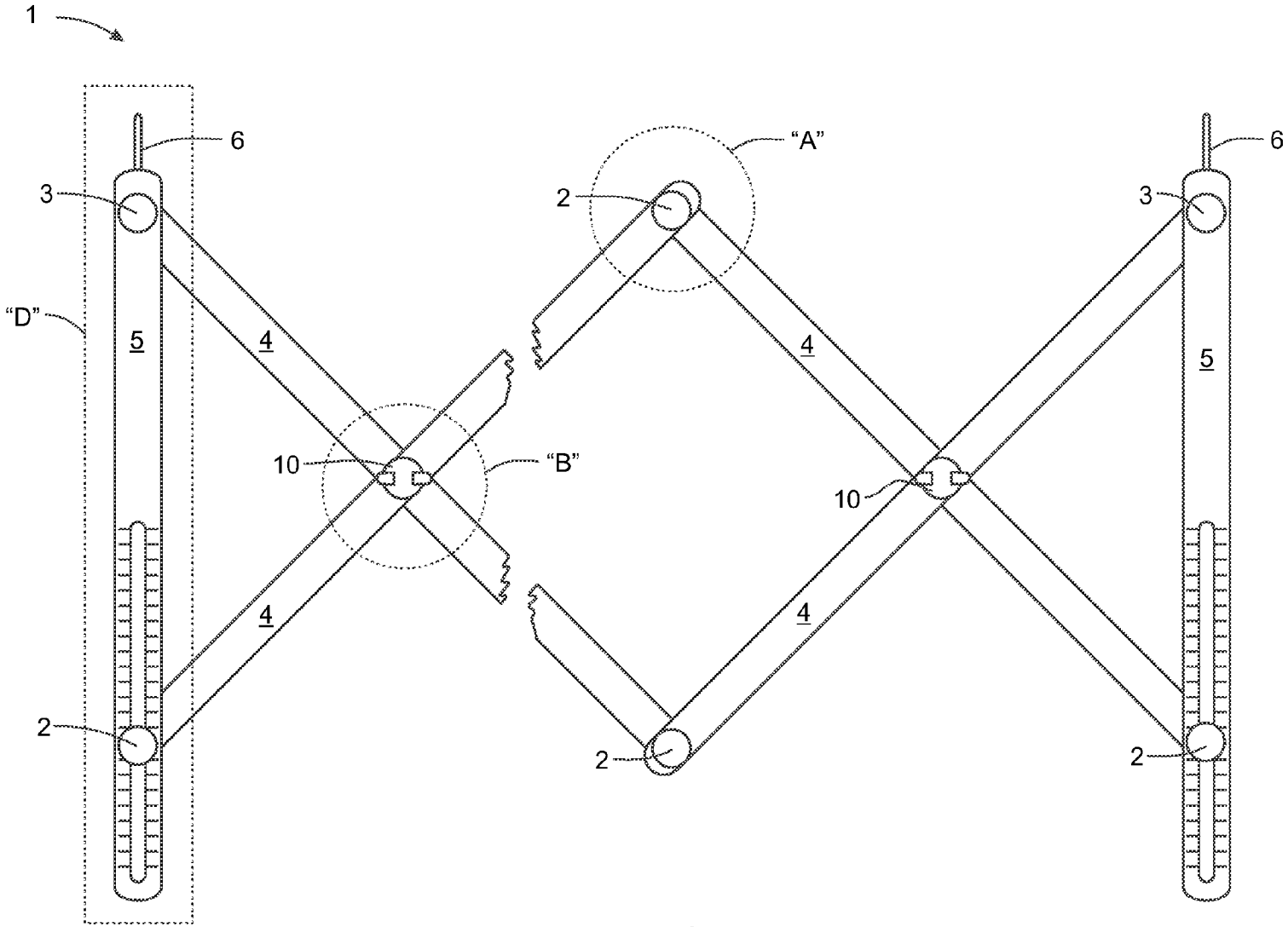
FIG. 1 is a front view of a portion of a frame in a partially open or extended position.
Figure 2:
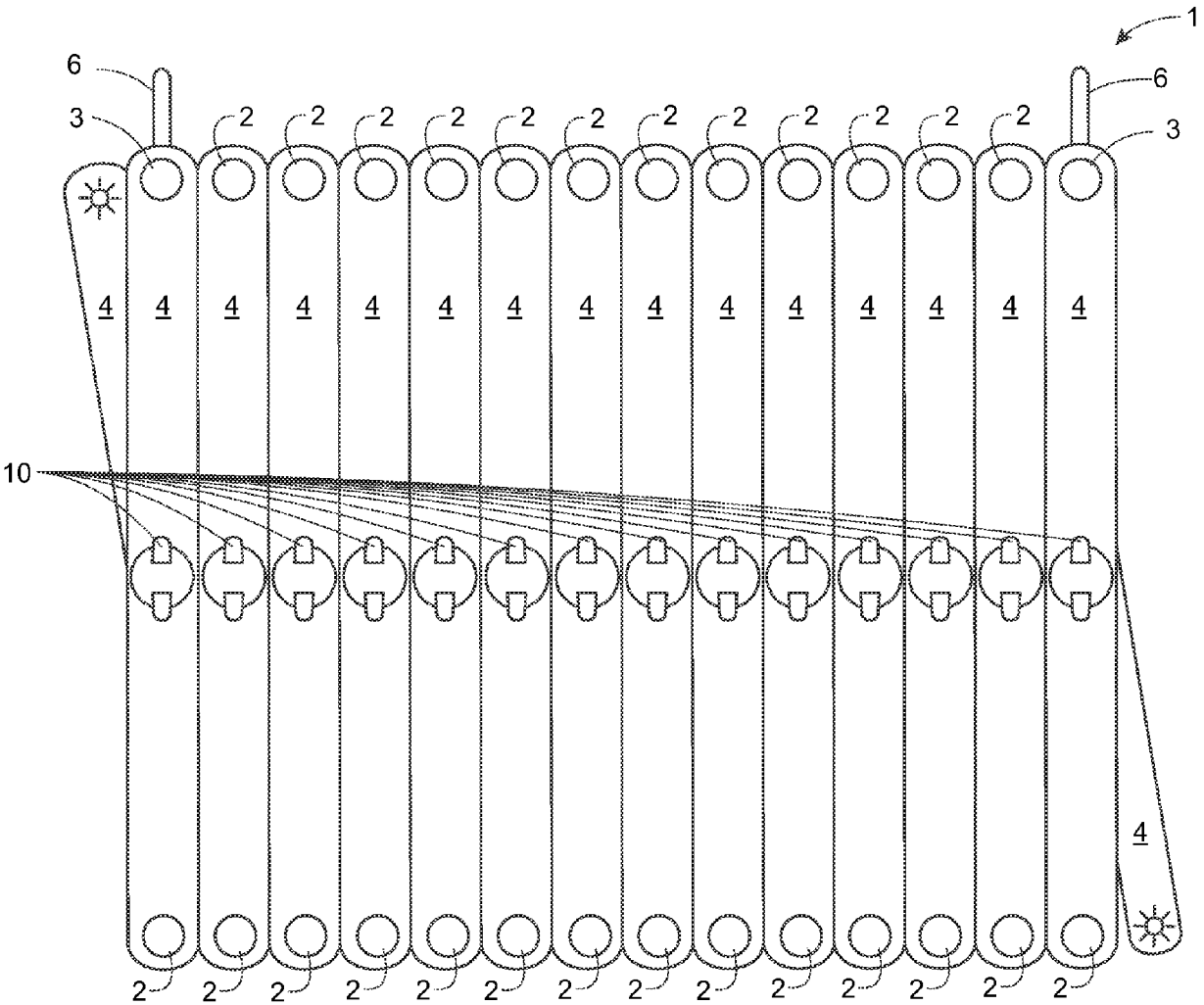
FIG. 2 is a front view of the frame shown in FIG. 1, depicting the frame in a closed or collapsed position, and without end arms of the frame installed thereon.

The frame 1 can be configured as a scissor bracket comprising fourteen pairs of interconnected arms 4, as shown in FIG. 2. Only two of the pairs of arms 4 are illustrated in FIGS. 1, 7, and 8, for clarity of illustration. The use of fourteen pairs of arms 4 is disclosed for exemplary purposes only. The optimum number of arms 4 is application-dependent, and can vary with factors such as the required overall length of the frame 1, which in turn is driven by factors such as the overall length of the light string 12, and the space available to accommodate the frame 1. Moreover, the use of multiple pairs of arms 4 configured in a scissor arrangement is disclosed for exemplary purposes only. The frame 1 can have other configurations in alternative embodiments. The arms 4 and 5 can be made of a rigid or semi-rigid material or materials, such as plastic, with sufficient strength to allow the frame member 1 to support light string 12.

Figure 3F:
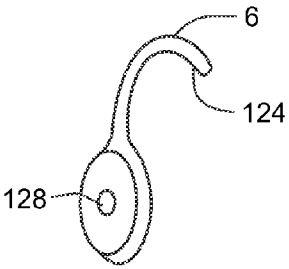
FIG. 3F is a perspective view of a hanger of the frame shown in FIGS. 1-3E.
Figure 3G:
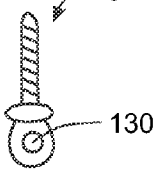
FIG. 3G is a side view of an eye screw of the frame shown in FIGS. 1-3F.
Figure 3H:
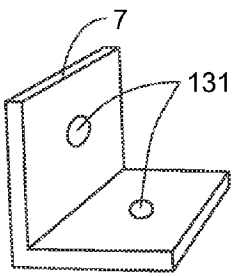
FIG. 3H is a perspective view of a bracket used to connect two of the frames shown in FIGS. 1-3G.
Figure 3E:
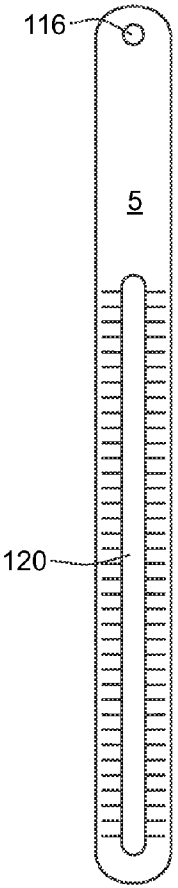
FIGS. 3D and 3E are side views of arms of the frame shown in FIGS. 1-3C.
Figure 3D:
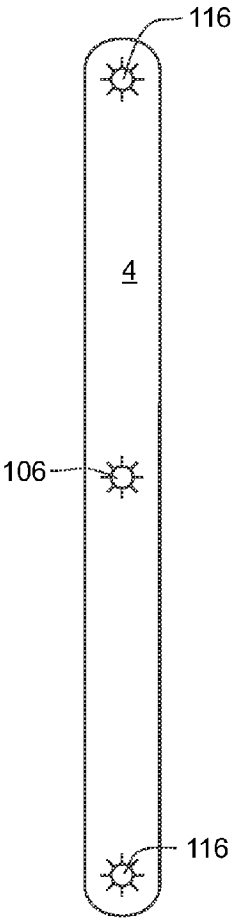
Figure 3A:
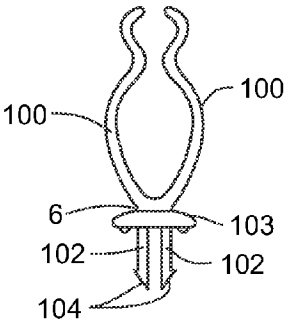
FIG. 3A is a side view of a light clip of the frame shown in FIGS. 1 and 2.

Each pair of arms 4 can be pivotally connected at their respective centers by a clip 10, as shown in FIGS. 1, 2, 3A, 5, and 7-11. Each clip 10 can include a pair of curved arms 100, a pair of straight arms 102, and a substantially flat middle portion 103 that adjoins, and is located between the curved arms 100 and the straight arms 102 as depicted in FIG. 3A. The curved arms 100 of each clip 10 can accommodate a light sockets 14 of different diameters, as shown in FIG. 3A. The curved arms 10 can resiliently deflect outwardly in response to the insertion of the socket or wiring 18 therebetween, and the resilience of the curved arms 10 causes the curved arms 10 to exert a clamping force on the light socket 14 disposed therebetween. The optimal dimensions of the curved arms 100 are determined by size of light socket 14 to be accommodated by the clip 10.

Figure 5:
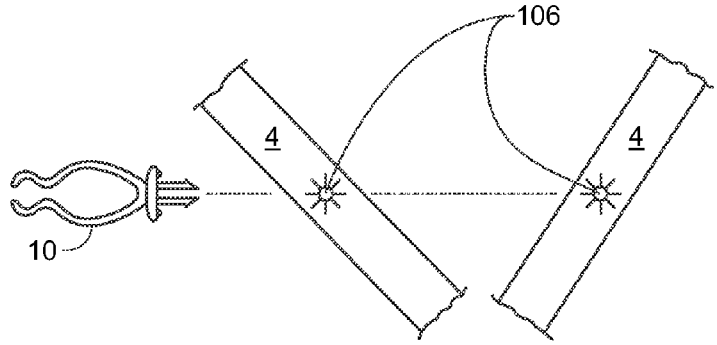
FIG. 5 is an exploded view of the area designated "B" in FIG. 1.

The straight arms 102 of each clip 10 are received in circular holes 106 formed in each of two arms 14 that are being interconnected by the clip 10. The holes 106 are located at the approximate midpoint of each arm 4, as depicted in FIGS. 3D and 5. Thus, the light string 12 extends along the approximate midpoint of the frame 1 when the clips are installed in the holes 106, as shown in FIG. 7. Each straight arm 102 has a barb 104 located at the end thereof, as shown in FIG. 3A. The barbs 104, when inserted through the holes 106, cause the straight arms 102 to deflect inwardly, toward each other, so that the barbs 104 can pass through the holes 106. The length of the straight arms 102 is chosen so that the adjacent portions of the arms 4 fit between the barbs 104 and the middle portion 103 of the clip 10 with minimal clearance after the barbs 104 have passed through the holes 106. Interference between the barbs 104 and the surface of the adjacent arm 4 retains the clip 10 on the arms 4, and maintains the adjacent arms 4 in a pivotally connected relationship with each other.

Figure 3B:
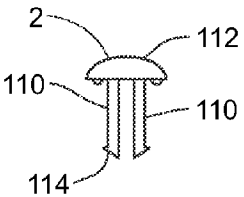
FIGS. 3B and 3C are side views of pins of the frame shown in FIGS. 1-3A.
Figure 3C:
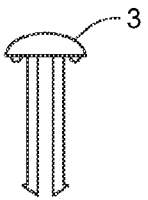

The ends of each arm 4 can be pivotally connected to the ends of adjacent arms 4 by a pin 2, as depicted in FIGS. 1, 2, 3B, 4, and 7-11. Each pin 2 can include a pair of straight arms 110, and a substantially flat end portion 112 that adjoins an end of each straight arm 112, as shown in FIG. 3B.

Figure 4:
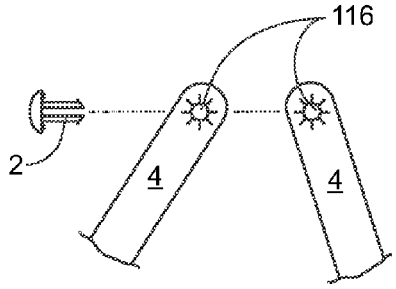
FIG. 4 is an exploded view of the area designated "A" in FIG. 1.

The straight arms 110 of each pin 2 are received in circular holes 116 formed in each of the arms 4. The holes 116 are located proximate the ends of each arm 4, as depicted in FIG. 3D and 4. Each straight arm 110 has a barb 114 located at the end thereof. The barbs 110, when inserted through the holes 116, cause the straight arms 110 to deflect inwardly, toward each other, so that the barbs 114 can pass through the holes 116. The length of the straight arms 110 is chosen so that the adjacent portions of the arms 4 fit between the barbs 114 and the end portion 112 of the pin 2 with minimal clearance after the barbs 114 have passed through the holes 116. Interference between the barbs 114 and the surface of the adjacent arm 4 retains the pin 2 on the arms 4, and maintains the adjacent arms 4 in a pivotally connected relationship with each other.

The use of the pins 2 and the clips 10 to connect the arms 4 is disclosed for exemplary purposes only. Other suitable connecting means that interconnect the arms 4 while facilitating the desired relative movement therebetween can be used in the alternative. Moreover, the clips 10 can be installed in the holes 116 proximate the ends of the arms 4 in alternative embodiments, so that the light string 12, or additional light strings 12, can extend along the top and/or bottom of the frame 1. The pins 2 can be installed in the holes 106 proximate the midpoint of the arms 4 in lieu of the clips 10 in embodiments in which the light string or strings 12 are extend along the top and/or bottom of the frame 1.

Figure 6A:
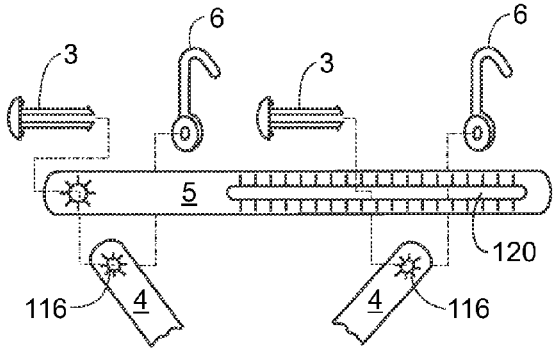
FIG. 6A is an exploded view of the area designated "C" in FIG. 8.
Figure 6B:
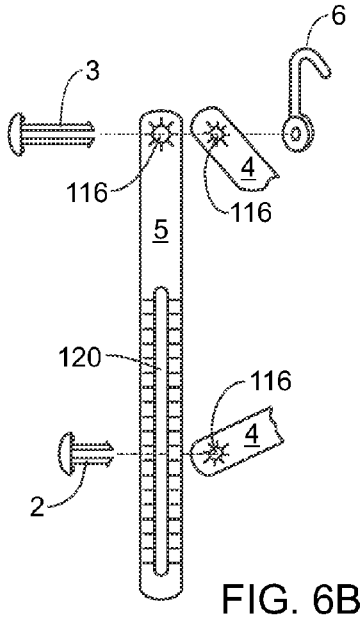
FIG. 6B is an exploded view of the area designated "D" in FIG. 1.

The frame 1 also includes one or two arms 5 positioned at one or both ends of the frame 1, as shown in FIGS. 1, 7, and 8. The ends of each arm 5 can be pivotally connected to the ends of two adjacent arms 4 by two pins 2. One of the pins 2 can be accommodated by one of the circular holes 116 formed in one of the adjacent arms 4, and by another circular hole 116 formed in the arm 5 proximate an end thereof. The other pin 2 can be accommodated by one of the circular holes 116 in the other adjacent arm 4, and by an elongated slot 120 formed in the arm 5 as shown in FIGS. 3E, 6A, and 6B.

The pin 2 located within the slot 120 can slide along the length of the slot 120. The ability of the pin 2 to move in this manner permits the overall length of the frame 1 to be varied. More specifically, the frame 1 can be extended and collapsed between its open and closed positions, and positions between the open and closed positions. This feature permits the length of the frame 1 to be adjusted to suit a particular application. The pin 2 located within the slot 120 can be configured with a locking feature (not shown), such as a wing nut, that permits the pin 2 to lock the adjacent arms 4 (and the frame 1) in a particular position once the frame 1 has been extended to a desired length.

One or both of the pins 2 can be removed from the arm 5, to permit the frame 1 to assume the fully collapsed configuration shown in FIG. 2 and thereby facilitate storage of the frame 1 in a compact state.

The arm 5 can be formed with a second circular hole 116 in lieu of the slot 120 in alternative embodiments in which is not necessary to adjust the length of the frame 1. Moreover, the use of the pins 2 to connect the ends of the arms 4 and 5 is disclosed for exemplary purposes only. Other suitable connecting means that facilitate the desired relative movement of the arms 4 and 5, while facilitating the desired relative movement therebetween and relatively easy disconnection and reconnection thereof can be used in the alternative.

Figure 9:
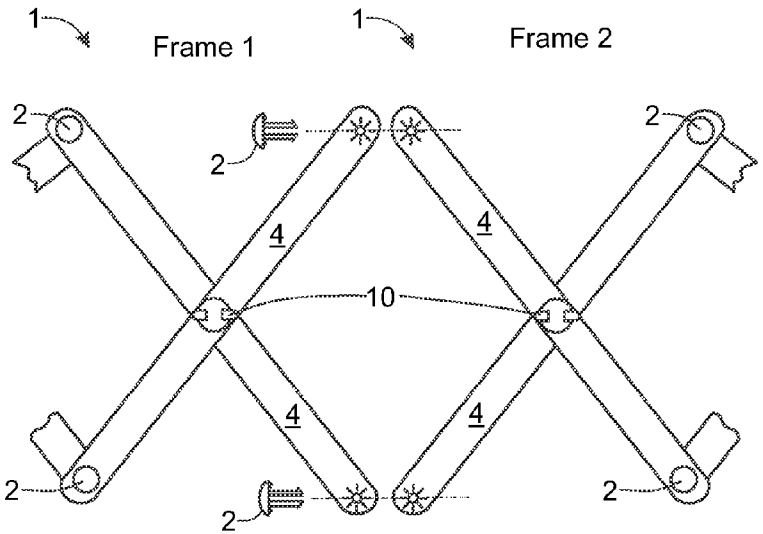
FIG. 9 is a front view illustrating how two of the frames shown in FIGS. 1-8, can be connected together.
Figure 10:
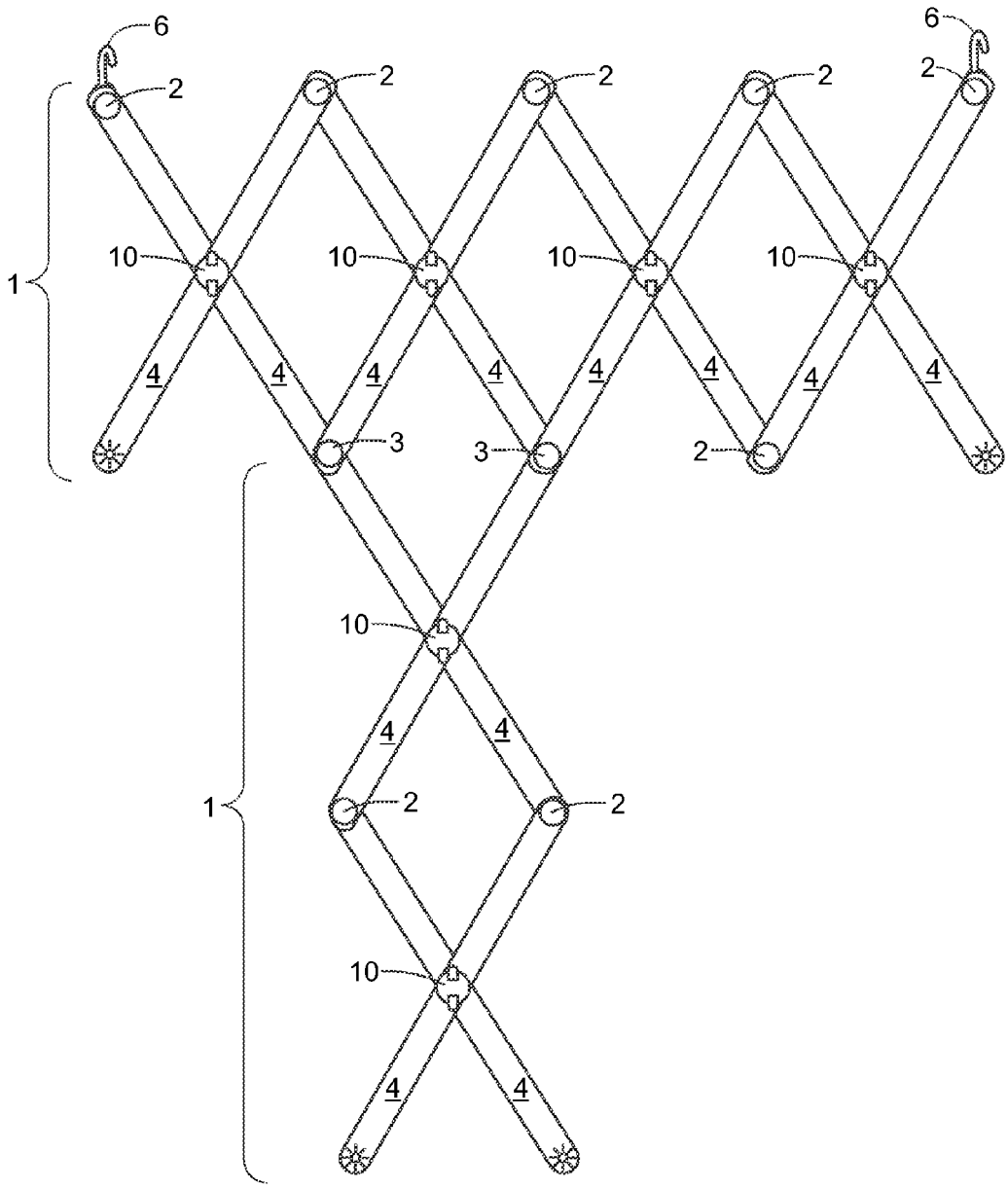
FIGS. 10 and 11 are front views illustrating other ways in which two of the frames shown in FIGS. 1-9 can be connected together.
Figure 11:
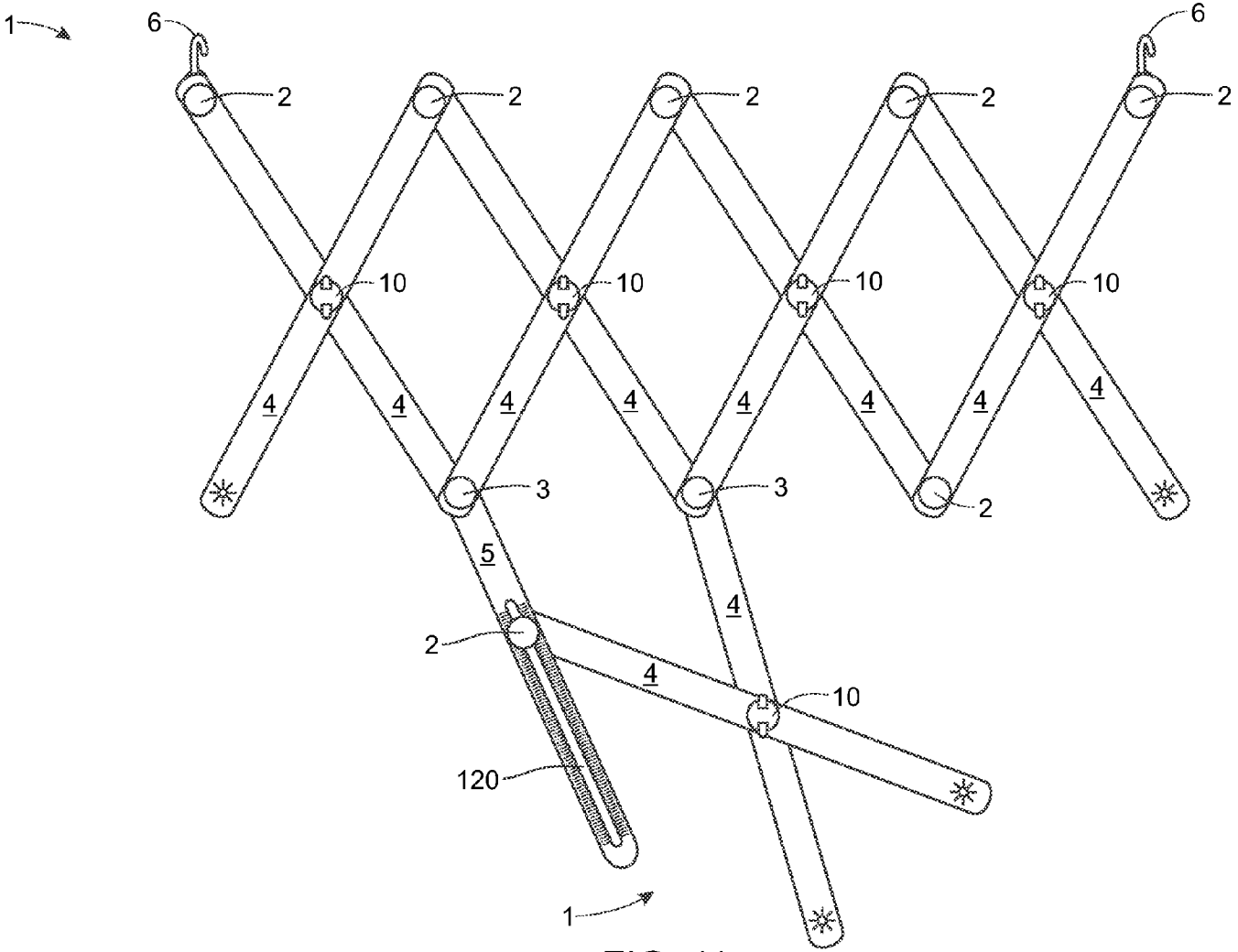

FIG. 9 illustrates how two or more of the frames 1 can be connected to form a system that spans a distance greater than the length of one frame 1. Two of the frames 1 can be connected by removing one of the arms 5 of each frame 1 from its adjacent arms 4, and connecting the adjacent arm 4 of the two frames using the pins 2. FIGS. 10 and 11 depict other ways in which two of the frames 1 can be interconnected.

The light string 12 can be mounted on the frame 1 by attaching each light socket 14 to a respective clip 10 on the frame 1 while the frame 1 is in its open or extended position. Adjacent sockets 14 on the string 12 can be mounted on adjacent clips 10 on the frame 1, to help maintain substantially uniform spacing between the light bulbs 16.

The frame 1 can subsequently be mounted at the location at which the light string 12 it is to be displayed. In particular, the frame 1, with the light string 12 attached thereto, can be carried to the mounting location in its open or closed position. If necessary, the frame 1 can be opened once is has been carried to the mounting location. The orientation, or clock position, of each light socket 14 can be adjusted to provide the light bulbs 16 with a uniform appearance across the light string 12. These adjustments can be performed before or after the frame 1 and light string 12 have been moved to the mounting location. The frame 1 can be suspended from a structure, such as a roof eave 123 shown in FIG. 8 or a gutter 125 shown in FIG. 7, using any appropriate means such as hooks, wire, etc.

The frame 1 can include mounting provisions. For example, the frame 1 optionally can include hangers 6, shown in FIGS. 1, 2, 3F, 6A, 6B, and 7-11. Each hanger 6 has a hooked portion 124, and a substantially flat portion 126 that adjoins the hooked portion 124. The flat portion 126 has a circular hole 128 formed therein that receives a pin 3.

The hanger 6 can be attached to the remainder of the frame 1 by pins 3. Each pin 3 is substantially identical to the pin 2, with the exception that the length of the straight arms of the pins 3 is greater than the length of the straight arms 110 of the pins 2, to accommodate the thickness of the hanger 6. The hole 128 of the hanger 6 can be aligned with the holes 106 or 116 of an associated pair of the arms 4, or with the holes 106 and/or the slot 120 of an associated pair of the arms 4, 5. The pin 3 can be inserted into and through the hole 128 of the hook 6 via the holes 106, 116 and/or the slot 120, until the barbs of the pin 3 have cleared the hole 128. The barbs and the substantially flat end portion of the pin 3 engage the adjacent surfaces of the hook 6 and the arms 4 or 5, and thereby maintain the hook 6, and the arms 4 and/or 5 in proximity to each other.

Provisions, such as eye screws 8 depicted in FIGS. 3G and 8, can be installed on the mounting surface if suitable provisions are not present for accommodating the hangers 6. Each eye screw 8 has a circular hole 130 formed therein that receives the hooked portion 124 of a corresponding hanger 6. The frame 1 can be extended or collapsed as needed to align the hangers 6 with the mounting provisions on the mounting surface.

In the embodiment disclosed in FIGS. 1-11, only two of the hangers 6 are required. Thus, the frame 1 and the light string 12 can be hung from the mounting surface with relatively little effort, and in a relatively short amount of time in comparison to a mounting methodology in which every clip 10 is individually mounted on the mounting surface. Moreover, the hangers 6 can be configured so that the frame 1 can be suspended in a substantially horizontal orientation as shown in FIGS. 1 and 7, or a substantially vertical orientation as shown in FIG. 8.

The frame 1 and the light string 12 can be removed from the display location by disengaging the hangers 6 from their mounting provisions. The frame 1 can be collapsed to its closed position with the light string 12 mounted thereon, and the frame 1 and light string 12 can be stored together until they are needed again.

Figure 13:
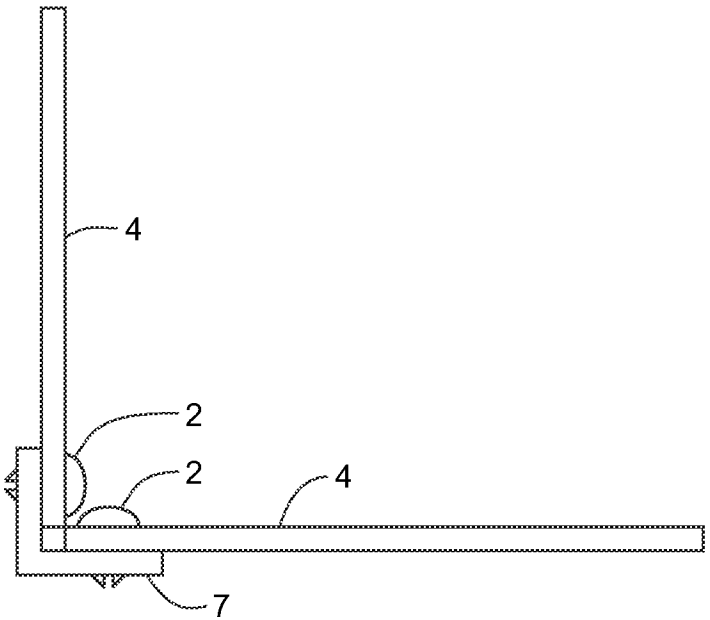
FIGS. 12 and 13 are top views illustrating how two of the frames shown in FIGS. 1-11 can be connected together using a bracket.
Figure 12:
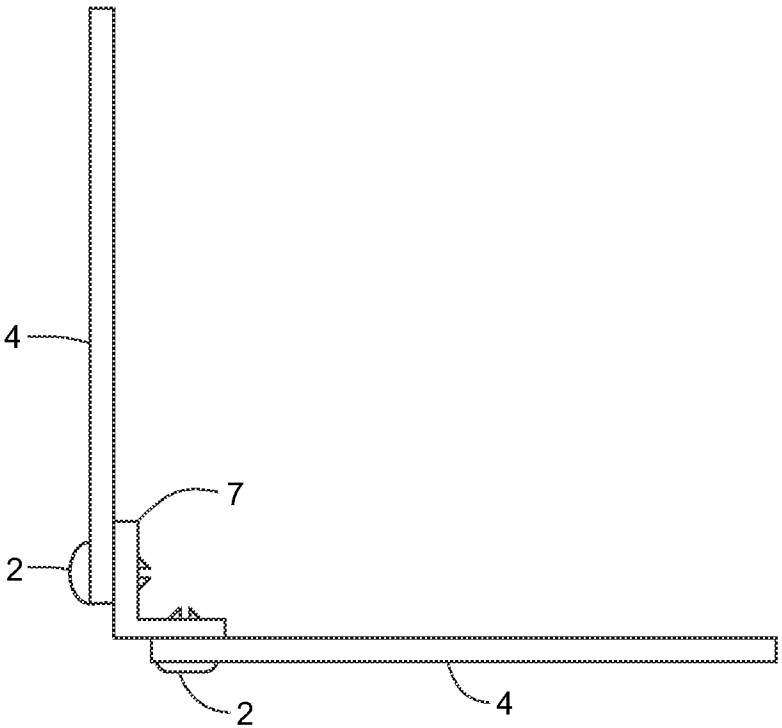

FIGS. 12 and 13 are top views of two of the frames 1 connected to each other, where the frames 1 are positioned substantially at right angles in relation to each other. This arrangement can be used, for example, where the lighting string 12 is being run around a corner. The frames 1 can be connected using a bracket 7, shown in FIG. 3H. The bracket 7 has holes 131 formed therein. Each hole can be aligned with corresponding hole 116 on one of the arms 4. A pin 2 can be inserted into the aligned holes 131 to connect the bracket 7 to the associated arm 4.

Figure 14A:
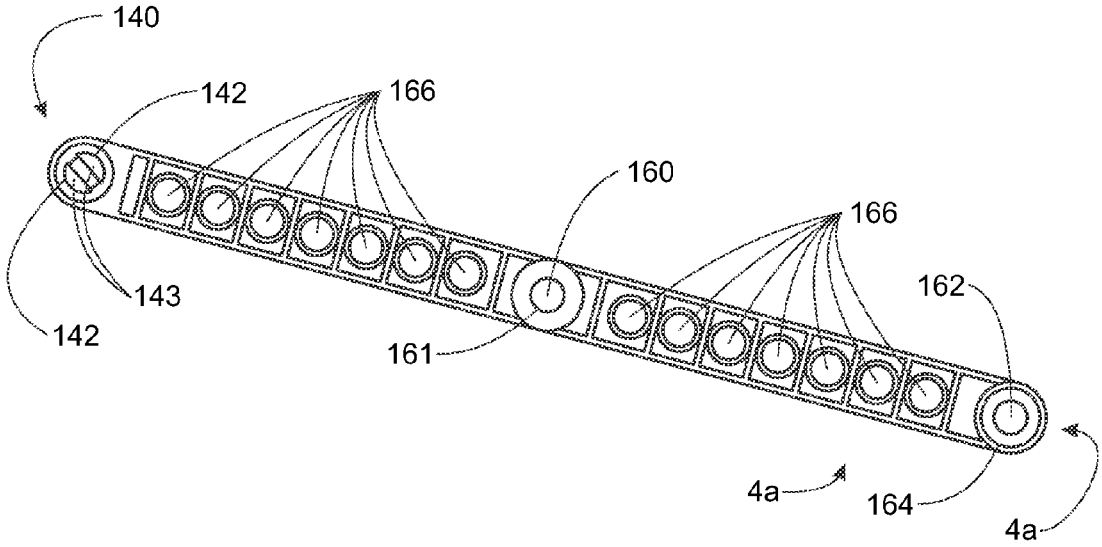
FIGS. 14A and 14B are top perspective and top views, respectively, of an arm of an alternative embodiment of the frame shown in FIGS. 1-13.
Figure 14B:
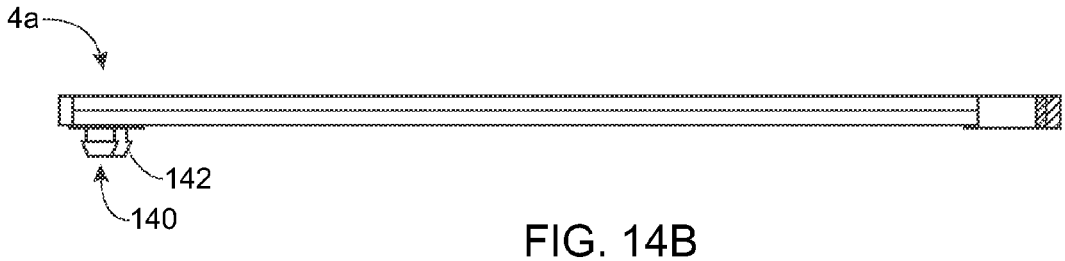
Figure 18:
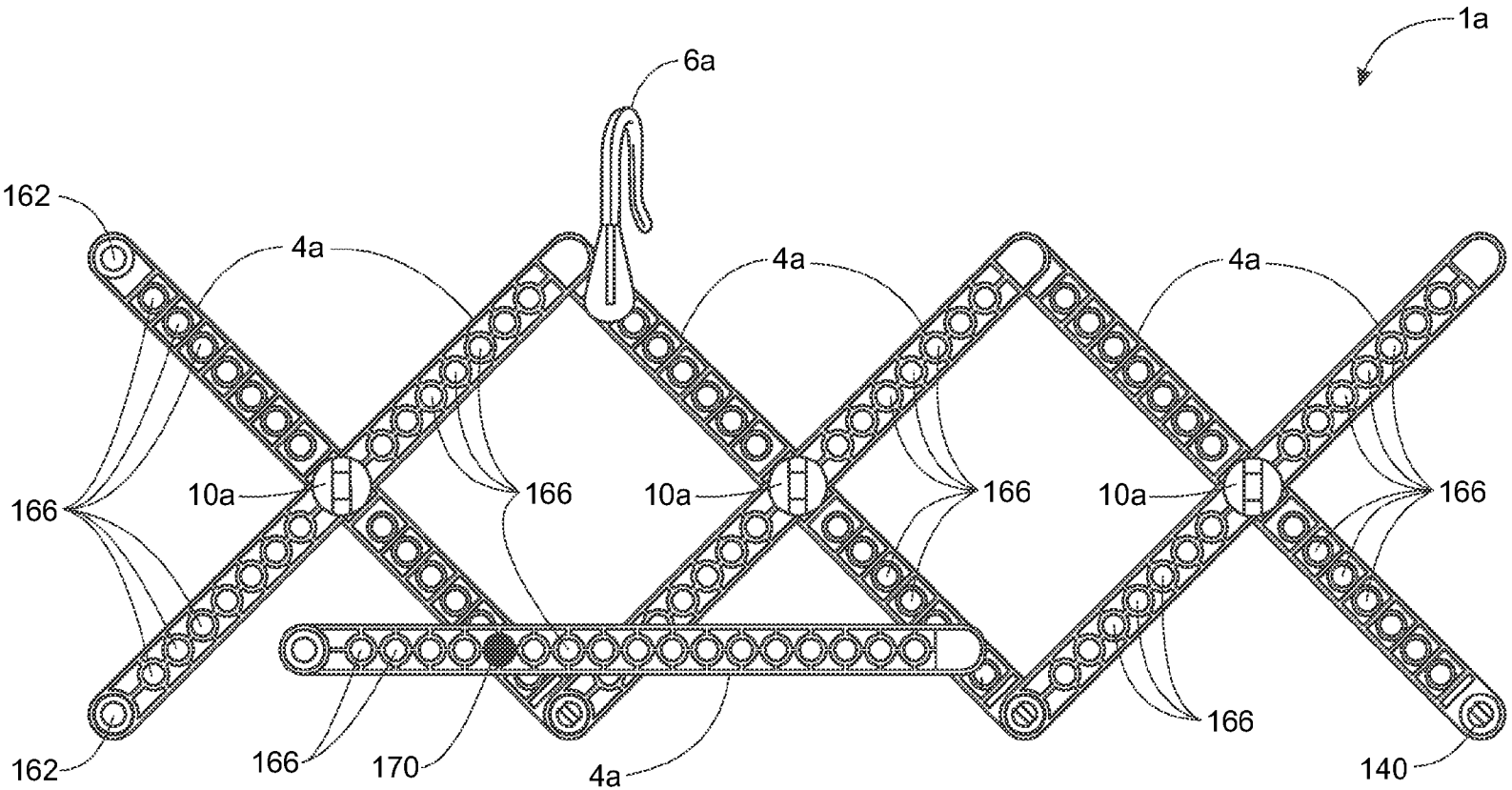
FIG. 18 is a front view of the alternative embodiment referenced in FIGS. 14A-17, in an extended and locked position.

FIG. 18 depicts an alternative embodiment of the frame 1 in the form of a frame 1*a*. The frame 1*a* comprises a plurality of arms 4*a*. Each arm 4*a* has a pin 140 integrally formed at one end thereof, as shown in FIGS. 14A and 14B. The pin 140 comprises two straight arms 142 each having a barb 143 formed at the free-standing lower end thereof, and an upper portion 144 that adjoins the straight arms 142.

Figure 17:
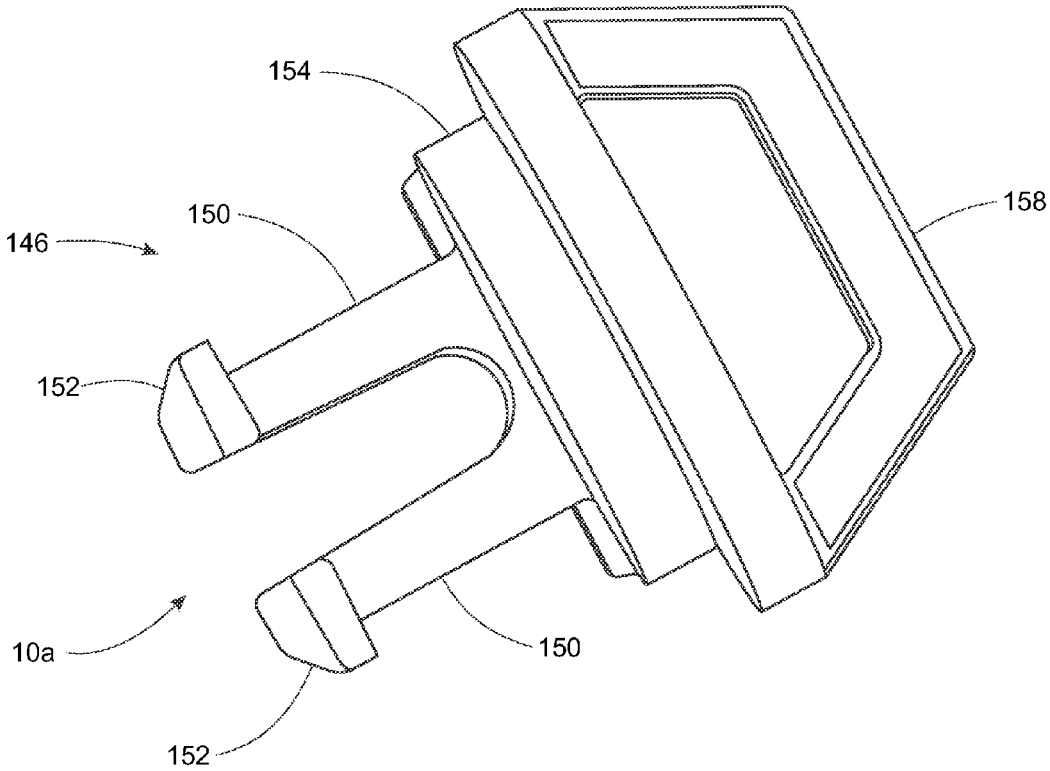
FIG. 17 is a perspective view of a pin of the alternative embodiment referenced in FIGS. 14A-16.

Each of the arms 4*a* can be pivotally connected to another arm 4*a* by a pin 146, shown in FIG. 17. The pin 146 comprises two straight arms 150 each having a barb 152 formed in the freestanding end thereof. The pin 146 also comprises an intermediate portion 154 that adjoins the straight arms 150, and a bracket 158 that adjoins the intermediate portion 154.

Each arm 4*a* has a circular hole 160 located at its approximate midpoint, as depicted in FIG. 14A. The holes 160 of the adjacent arms 4*a* are aligned, and the straight arms 150 of the pin 146 are inserted through the holes 160 until the barbs 152 have cleared both of the arms 4*a*, and the intermediate portion 154 is disposed in a recess 161 formed in the arm 4*a*. Interference between the barbs 152 and the surface of the adjacent arm 4*a* retains the pin 146 on the arms 4*a*, and maintains the adjacent arms 4*a* in a pivotally connected relationship with each other. The lighting string 12 or other objects can be suspended from the bracket 158 using cable ties or other suitable means.

Each arm 4*a* has another circular hole 162 formed proximate an end thereof, as shown in FIGS. 14 and 18. The arms 4*a* are oriented as shown in FIG. 18, so that the straight arms 142 of the pin 140 of one arm 4*a* engages the holes 162 of an adjacent arm 4*a*. The resulting interference between the barbs 143 of the straight arms 142 and the surface of the adjacent arm 4*a* retains the pin 140 in the hole 162, and maintains the adjacent arms 4*a* in a pivotally connected relationship with each other. Moreover, the upper portion 144 of the pin 140 is disposed in a recess 164 formed in the arm 4*a*.

Figure 15:
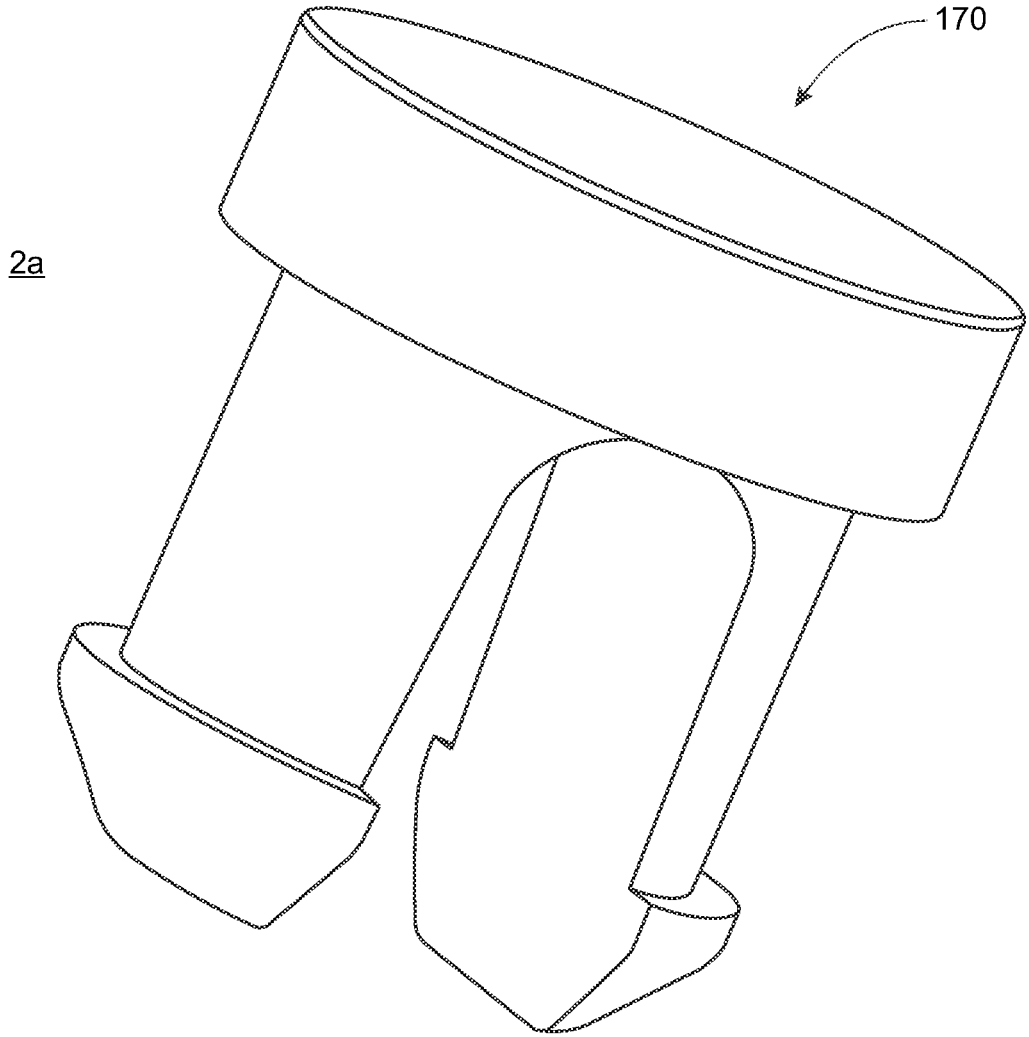
FIG. 15 is a perspective view of a pin of the alternative embodiment referenced in FIGS. 14A and 14B.

The frame 1*a* can be locked in an extended position using one of arms 4*a* as a locking arm 4*a*, as depicted in FIG. 18. In particular, each arm 4*a* has fourteen circular holes 166 formed therein between is mid and end points, as shown in FIGS. 14 and 18. Once the frame 1*a* has been extended to a desired length, the pin 140 of the arm 14*a* being used as a locking arm 4*a* can be inserted into one of the holes 166 of one of the other arms 4*a* to connect the two arms 4*a*. A hole 166 in the locking arm 4*a* can be aligned with one of the holes 166 in another one of the arms 4*a*, and a pin 170, shown in FIG. 15, can be inserted into the aligned holes 166 to connect these two arms

4*a*. The connection of the locking arm 4*a* to the other two arms 4*a* locks the frame 1*a* in its extended position.

Figure 16:
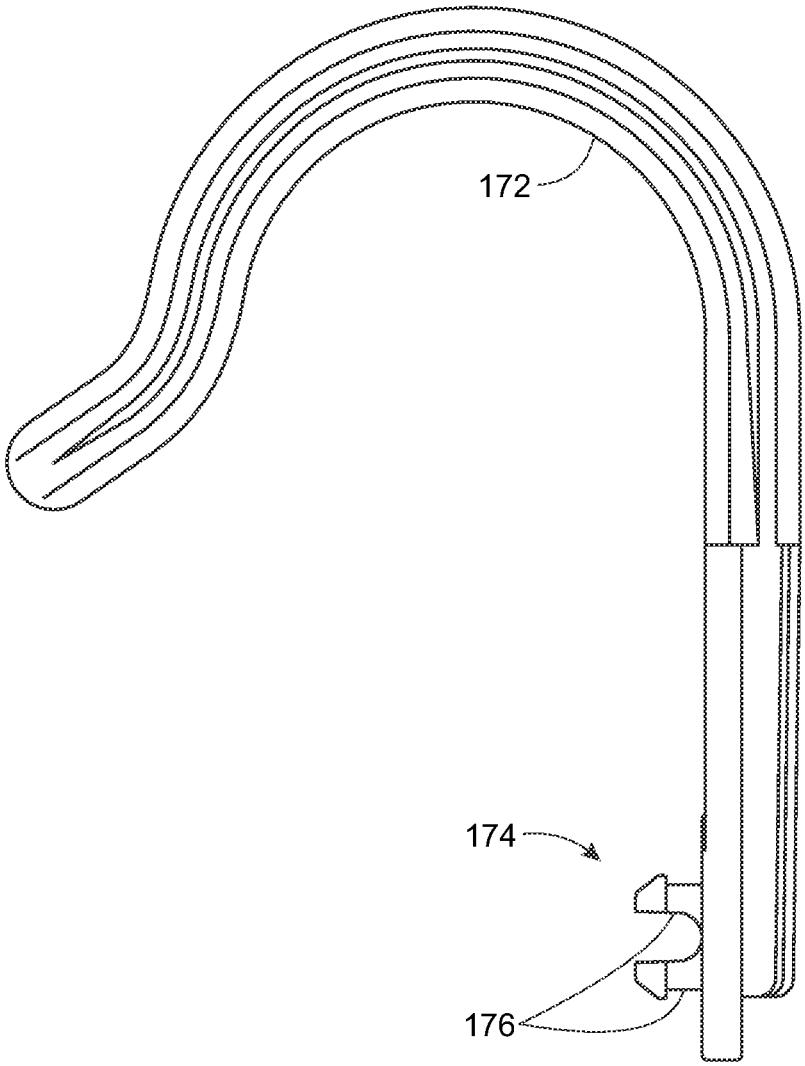
FIG. 16 is a side view of a hanger of the alternative embodiment referenced in FIGS. 14A-15.

FIG. 16 depicts a hanger 6*a* that can be used as part of the frame 1*a*. The hanger 6*a* includes a hook portion 172, and an adjoining pin 174. The pin 174 includes two arms 176 having barbs formed at the freestanding ends thereof. The arms 176 can be inserted into a hole 166 on one of the arms 4*a* at a desired location on the frame 1*a*, so that the hanger 6*a* engages the arm 4*a*.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, can make numerous modifications to the invention as described herein, and changes may be made without departing from the scope and spirit of the invention as defined by the appended claims.

What is claimed is:

1. A method for mounting a light string, comprising:

providing a collapsible scissor frame having a generally linear configuration that is movable between an extended position at which the frame has a first length, and a collapsed position at which the frame has a second length that is less than the first length;

wherein:

the collapsible frame includes a plurality of arms arranged in pairs, each pair of arms having a straight configuration being mechanically connected so that respective pairs of arms rotate in relation to each other;

the light string includes a plurality of electrically interconnected light sockets, and the collapsible frame includes a plurality of clips that each engage a corresponding one of the light sockets;

each of the clips is mounted at respective center points of a respective associated pair of arms such that the associated pair of arms are pivotally connected;

mounting the light string on the frame while the frame is in the extended position;

subsequently moving the frame and the light string to a mounting location; and suspending the frame and the light string from a mounting provision at the mounting location.

2. The method of claim 1, further comprising:

removing the frame and the light string from the mounting area; and collapsing the frame to the collapsed position with the light string mounted thereon.

3. The method of claim 1, wherein mounting the light string on the frame while the frame is in the extended position includes attaching light sockets of the light string to respective clips on the frame.

4. The method of claim 1, wherein:

each arm of said associated pair of arms defines an arm hole proximate opposed arm ends thereof;

a plurality of pins, a respective pin being selectively received in respective arm holes of two adjacent associated pair of arms such that said two adjacent associated pair of arms are pivotally coupled together;

at least one end arm having opposed ends and an elongate configuration, said at least one end arm defining a circular hole adjacent one of the opposed ends and defining a slot situated between said circular hole and another opposed end of said end arm;

wherein one respective pin couples said at least one end wall to a respective arm of a respective pair of arms, said respective pin is received through a respective arm hole of a respective arm and through said circular hole adjacent one of the opposed ends of the at least one end arm; and wherein another respective pin is received through another respective arm hole of a respective arm and through said slot of said at least one end wall, said another respective pin being slidable along said slot.

5. The method of claim 1, further comprising mechanically connecting the collapsible frame to another collapsible frame.

6. The method of claim 1, further comprising adjusting an overall length of the frame.

7. The method of claim 6, further comprising locking the relative positions of the arms of the frame after adjusting the overall length of the frame.

8. A lighting system for mounting to an exterior of a building structure adjacent an eave of a roof, comprising:

a collapsible scissor frame having a linear configuration movable between an extended position at which the frame has a first length, and a collapsed position at which the frame has a second length that is less than the first length;

wherein the collapsible frame includes a plurality of arms arranged in pairs, each pair of arms having a straight configuration being pivotally coupled together at respective center points so that respective pairs of arms rotate in relation to each other;

a light string mounted on the frame;

wherein:

the light string comprises a plurality of electrically interconnected light sockets, and the collapsible frame includes a plurality of clips that each engage a corresponding one of the light sockets each of the clips is mounted at respective center points of a respective associated pair of arms such that the associated pair of arms are pivotally connected.

9. The lighting system of claim 8, further comprising two of the frames mechanically connected to each other.

10. The lighting system of claim 9, wherein the clips can rotate to facilitate adjustment of the orientations of the light sockets.

11. The lighting system of claim 8, further comprising means for varying an overall length of the frame and locking the frame at a particular length.

12. The lighting system of claim 8, wherein:

each arm of said associated pair of arms defines an arm hole proximate opposed arm ends thereof;

a plurality of pins, a respective pin being selectively received in respective arm holes of two adjacent associated pair of arms such that said two adjacent associated pair of arms are pivotally coupled together.

13. The lighting system of claim 12, further comprising:

at least one end arm having opposed ends and an elongate configuration, said at least one end arm defining a circular hole adjacent one of the opposed ends and defining a slot situated between said circular hole and another opposed end of said end arm;

wherein one respective pin couples said at least one end wall to a respective arm of a respective pair of arms, said respective pin is received through a respective arm hole of a respective arm and through said circular hole adjacent one of the opposed ends of the at least one end arm; and wherein another respective pin is received through another respective arm hole of a respective arm and through said slot of said at least one end wall, said another respective pin being slidable along said slot;

whereby movement of said another respective pin along said slot enables an overall length of said collapsible frame to be modified.

14. The lighting system of claim 13, wherein said another respective pin includes a locking element configured to selectively lock said plurality of arms and said at least one end arm at a length adjusted configuration.

15. The lighting system of claim 8, wherein each clip includes:

a pair of curved arms;

a pair of straight arms;

a substantially flat middle portion that adjoins and is located between the curved arms and the straight arms;

wherein the curved arms selectively receive a respective light socket of the light string.

* * * * *